US012392156B2

(12) United States Patent
Wu et al.

(10) Patent No.: US 12,392,156 B2
(45) Date of Patent: Aug. 19, 2025

(54) SWIMMING POOL SEWAGE SUCTION MACHINE AND CONTROL METHOD THEREOF

(71) Applicants: ZHEJIANG KUOCHUANG TECHNOLOGY CO., LTD., Zhejiang (CN); ZHEJIANG SAFUN INDUSTRIAL CO., LTD., Zhejiang (CN)

(72) Inventors: Changda Wu, Zhejiang (CN); Shurong Lv, Zhejiang (CN); Li Huang, Zhejiang (CN); Qihang Li, Zhejiang (CN); Yiheng Ying, Zhejiang (CN); Kuo Ying, Zhejiang (CN); Xinsen Ying, Zhejiang (CN)

(73) Assignees: ZHEJIANG KUOCHUANG TECHNOLOGY CO., LTD., Yongkang (CN); ZHEJIANG SAFUN INDUSTRIAL CO., LTD., Yongkang (CN)

( * ) Notice: Subject to any disclaimer, the term of this patent is extended or adjusted under 35 U.S.C. 154(b) by 456 days.

(21) Appl. No.: 18/058,747

(22) Filed: Nov. 24, 2022

(65) Prior Publication Data

US 2023/0349186 A1 Nov. 2, 2023

(30) Foreign Application Priority Data

Apr. 28, 2022 (CN) ..... 202210469440.6

(51) Int. Cl.
*E04H 4/16* (2006.01)

(52) U.S. Cl.
CPC ..... *E04H 4/1654* (2013.01)

(58) Field of Classification Search
None
See application file for complete search history.

(56) References Cited

U.S. PATENT DOCUMENTS 5,435,031 A * 7/1995 Minami ..... E04H 4/1654 15/1.7
2018/0044936 A1* 2/2018 Torem ..... E04H 4/1654

* cited by examiner

*Primary Examiner* — Krishnan S Menon
(74) *Attorney, Agent, or Firm* — PROI Intellectual Property US

(57) ABSTRACT

A swimming pool sewage suction machine includes a base, a control system, a battery assembly, a driving wheel assembly, a sealing box, a water pump assembly, a collecting box, a top cover assembly, a brush assembly and a charging device and further includes a collision plate assembly, a collision return assembly, a rotary rod assembly, a magnetic induction piece and a Hall plate. The interior of the base is divided into an inner ring water distribution bin and an outer ring water distribution bin through the collecting box. The inner ring water distribution bin is annular, a middle part of the collecting box is provided with an up-down through annular docking base and is sleeved on the water pump assembly.

20 Claims, 11 Drawing Sheets

SWIMMING POOL SEWAGE SUCTION MACHINE AND CONTROL METHOD THEREOF

TECHNICAL FIELD

The present disclosure relates to the field of swinging pool cleaning, more particularly to a swimming pool sewage suction machine and a control method thereof.

BACKGROUND

Swimming pool sewage suction machine is a kind of machine that can be placed at the bottom of the swimming pool to clean dirt and the like on surfaces of the swimming pool. However, during the course of entering water, current swimming pool sewage suction machines sometimes would get side overturned because the center of gravity is generally on the front part or rear part. By the time, human labor is required to put the machine straight or hold the machine until the machine totally sinks into the water, not only consuming time, but also resulting in inconvenience for water entry. In addition, during the course of walking underwater, the swimming pool sewage suction machine would often hit on bulges on the bottom, which sometimes could cause great steering or side overturn of the machine.

In addition, during the course of walking underwater, the swimming pool sewage suction machine would often hit on obstacles or reach the boundary of the swimming pool. At present, the swimming pool sewage suction machine is provided with an indicator sail on the top to judge the boundary, that is, during normal walking, the indicator sail is driven by water currents to face the rear side, however, when the swimming pool sewage suction machine hits on an obstacle or the boundary, the indicator sail will rotate and return to the original position under the action of a return spring. However, such a judgement structure is not stable. When the swimming pool sewage suction machine passes through a bulge on the bottom or the bottom slope is great or the flow direction of water changes, the indicator sail is easy to steer, resulting in a misjudgment by the swimming pool sewage suction machine. Therefore, further improvement is needed.

SUMMARY

The present disclosure provides a new swimming pool sewage suction machine and a control method thereof, in view of the defects in the existing technologies that the posture of the swimming pool sewage suction machine is not stable enough during the course or entering water or walking underwater and the judgment for the boundary or obstacle at the bottom of the swimming pool is not accurate enough.

In order to solve the above technical problems, the present disclosure is implemented through the following technical scheme.

A swimming pool sewage suction machine includes a base, a control system, a battery assembly, a driving wheel assembly, a sealing box, a water pump assembly, a collecting box, a top cover assembly, a brush assembly and a charging device, wherein the control system is positioned inside the sealing box, the charging device is arranged on the base and is electrically connected to the control system inside the sealing box, the battery assembly is arranged inside the sealing box and is electrically connected to the control system, the brush assembly is arranged on a bottom of the base, the swimming pool sewage suction machine has an X axis, a Y axis and a Z axis at a center along the length direction, width direction and height direction respectively, wherein the swimming pool sewage suction machine further includes a collision plate assembly, a collision return assembly, a rotary rod assembly, a magnetic induction piece and a Hall plate, wherein the sealing box is arranged on a middle part of the bottom of the base, the driving wheel assembly and the water pump assembly are connected to the sealing box respectively and are electrically connected to the control system, the interior of the base is divided into an inner ring water distribution bin and an outer ring water distribution bin through the collecting box, a gas-liquid circulation hole is further defined in both a front end and a rear end of the bottom of the base and communicated with the outer ring water distribution bin, a sewage suction opening communicated with the inner ring water distribution bin is defined on a bottom of the collecting box, a sewage inlet corresponding to the sewage suction opening is further defined on the bottom of the base, the inner ring water distribution bin is annular, a middle part of the collecting box is provided with an up-down through annular docking base and is sleeved on the water pump assembly, a filter screen is arranged on a side wall of the annular docking base, an opening is defined a top part of the collecting box, and the top cover assembly is rotationally connected to the base and covers the opening on the top part of the collecting box, the collision plate assembly is arranged on an edge of the base and extends into the base, the collision return assembly is arranged inside the base and provides a restoring force for the collision plate assembly, the rotary rod assembly is rotationally connected inside the base, one end of the rotary rod assembly is connected to the collision plate assembly, the magnetic induction piece is arranged on the other end of the rotary rod assembly, the Hall plate is arranged inside the sealing box and cooperates with the magnetic induction piece, and the Hall plate is electrically connected to the control system.

The sealing box is arranged on the middle part of the bottom of the base, which can anchor the position of the center of gravity of the whole swimming pool sewage suction machine and improve the balance of the swimming pool sewage suction machine in entering water and walking underwater. The gas-liquid circulation holes are communicated with the outer ring water distribution bin, the sewage inlet and the sewage suction opening are communicated with the inner ring water distribution bin, enabling air and water currents to rapidly enter interiors of the outer ring water distribution bin and the inner ring water distribution bin through such parts during the course of the swimming pool sewage suction machine entering water and subsequently flow out through gaps on the base or the water pump assembly, and preventing air being covered to form a reacting force during the course of the swimming pool sewage suction machine entering water; consequently, not only the speed of the swimming pool sewage suction machine to enter water can be accelerated, but also the posture of the swimming pool sewage suction machine in entering water can be automatically stabilized, so that the machine can keep balanced.

In the condition that the machine is normally operating, the magnetic induction piece cooperates with the Hall plate inside the sealing box, and the machine is in an induction enabled state; in the case that the machine collides with an obstacle or the pool boundary while walking, the rotary rod assembly will be pushed while the collision plate assembly encounters a collision such that the magnetic induction piece on the rotary rod assembly is separated from the Hall plate, the control system receives a signal and then can determine that the machine has collided with an obstacle or the pool boundary, thereby making an preparation for a following action. After the end of collision, as the collision plate assembly leaves the obstacle or the pool boundary, the collision plate assembly can automatically return to the original position under the restoring force of the collision return assembly, thereby making a preparation for a next collision.

Through the arrangement of the above structure, on one hand, the stability of posture of the swimming pool sewage suction machine in entering water and walking underwater is guaranteed; and on the other hand, the influence of the slope, the concave-convex place at the bottom of the swimming pool and the change of water current on the judgement of an obstacle or a swimming pool boundary is avoided, and the accuracy of judgment is greatly improved.

Preferably, in the above swimming pool sewage suction machine, a diversion bin is further provided on the base at the gas-liquid circulation hole, the diversion bin is in the shape of a cover body with an opening downward and the projection of the diversion bin in the height direction of the swimming pool sewage suction machine is on the X axis, and the gas-liquid circulation holes are distributed on the diversion bin in an annular array.

The projection of the diversion bin in the height direction of the swimming pool sewage suction machine is on the X axis, which enables the swimming pool sewage suction machine to keep a better stability and balance during the operation of the swimming pool sewage suction machine. The cover body with an opening downward on one hand can reduce the influence of cross currents on the gas-liquid circulation hole during the underwater walking course, and on the other hand can better guide and gather air or water currents during the water entry course to accelerate the water entry speed. The gas-liquid circulation holes are distributed on the diversion bin in an annular array, so that the swimming pool sewage suction machine can better enter water during the water entry course, improving the smoothness of water entry.

Preferably, in the above swimming pool sewage suction machine, a counterweight is further arranged inside the sealing box and the counterweight is provided to be symmetrical in front and rear with the Y axis as a center line.

The counterweight can increase the weight of the machine, facilitating the swimming pool sewage suction machine to better enter water and walk underwater. The counterweight is provided to be symmetrical in front and rear with the Y axis as a center line so that the balance of the swimming pool sewage suction machine can be better kept.

Preferably, the above swimming pool sewage suction machine further includes a universal wheel, wherein the number of the universal wheel is two and they are connected to the front end and the rear end of the bottom of the base respectively, the projection of the universal wheel in the height direction of the swimming pool sewage suction machine is on the X axis, there are two driving wheel assemblies and they are connected to middle parts of left and right side surfaces of the sealing box respectively, and the projection of the driving wheel assembly in the height direction of the swimming pool sewage suction machine is on the Y axis.

The universal wheel holds responsibility for steering, the driving wheel assembly is configured to drive the swimming pool sewage suction machine to walk, the driving wheel assemblies are connected to middle parts of left and right side surfaces of the sealing box so that the gravity center anchoring function of the sealing box can be further enhanced. The projection of the universal wheel in the height direction of the swimming pool sewage suction machine is on the X axis, and the projection of the driving wheel assembly in the height direction of the swimming pool sewage suction machine is on the Y axis, forming a cross layout of wheels that further enhances the stability of the swimming pool sewage suction machine during the walking course.

Preferably, in the above swimming pool sewage suction machine, a distance between a center of the universal wheel and a center plane of the sealing box is 120 mm-200 mm.

Within the above distance range, not only the universal wheel is easy to steer, but also the stability of the swimming pool sewage suction machine can be well maintained.

Preferably, in the above swimming pool sewage suction machine, the sealing box is positioned at an intersection of the X axis, the Y axis and the Z axis, and the collecting box is provided to be symmetrical with the X axis and Y axis as center lines.

Through the above structure, the balance of the swimming pool sewage suction machine can be well kept.

Preferably, in the above swimming pool sewage suction machine, a ratio of a sectional area of the sewage suction opening to a sectional area of the gas-liquid circulation hole is 1.2:1~1.8:1.

The sectional area of the sewage suction opening is greater than the sectional area of the gas-liquid circulation hole so that the volume of air and water entering the sewage suction opening is greater than that entering the gas-liquid circulation hole during the course of the swimming pool sewage suction machine entering water, that is to say, the volume entering the inner ring water distribution bin is greater than that entering the outer ring water distribution bin, further enhancing the center anchoring effect of the gravity center of the whole swimming pool sewage suction machine and improving the stability of posture of the swimming pool sewage suction machine.

Preferably, in the above swimming pool sewage suction machine, a blocking structure is further arranged inside the collecting box close to the sewage suction opening, the blocking structure includes a blocking connection seat, a fastener and a flexible baffle, the blocking connection seat is arranged on an inner wall of the collecting box, one end of the flexible baffle is connected onto the blocking connection seat through the fastener, and the other end of the flexible baffle covers the sewage suction opening.

The flexible baffle is arranged on the inner wall of the collecting box so as to avoid the generation of friction between the flexible baffle and the swimming pool. The flexible baffle may better block foreign matters, preventing some exceptional objects being sucked into the collecting box.

Preferably, in the above swimming pool sewage suction machine, the top cover assembly includes a left rotating cover and a right rotating cover, the left rotating cover and the right rotating cover are rotatably connected onto the base respectively, a left notch is defined on the left rotating cover, a right notch is defined on the right rotating cover, the left notch and the right notch enclose a sleeve-connection opening which is positioned on the edge of the water pump assembly.

The left notch and the right notch are sleeved on the edge of the water pump assembly, which can effectively prevent overflow of dirt and achieve a better collection effect for the collecting box. Further, the structure design of a sleeve-connection manner eases the cleaning of the collecting box.

Preferably, in the above swimming pool sewage suction machine, the inner ring water distribution bin has a depth H of 20 mm~120 mm, the inner ring water distribution bin has a sectional area of 20000 $mm^2$~60000 $mm^2$, and the sewage suction opening has a sectional area of 2000 $mm^2$~6000 $mm^2$.

The depth H and the sectional area of the accommodating chamber affect indirectly the dirt collecting capability of the accommodating chamber. Within the above parameter range, not only the dirt collecting capability of the collecting box can be guaranteed, but also the stability of the machine can be well maintained. The sectional area of the sewage suction opening within the above range can better cooperate with the accommodating chamber to form a diffusion effect, so that the dirt sucked from the sewage suction opening can quickly diffuse to the whole accommodating chamber to avoid accumulation of dirt.

Preferably, in the above swimming pool sewage suction machine, two ends of the base are provided with a rotating connection seat, two ends of the brush assembly are provided with a rotating shaft, and the brush assembly is rotatably connected to the base through the rotating shaft and the rotating connection seat.

Two ends of the brush assembly are provided with a rotating shaft, because of which the brush assembly will rotate automatically in a reverse direction of the movement direction of the swimming pool sewage suction machine during the course of the machine moving forward; even if the machine hits on the bulge on the bottom of swimming pool, it will not be jacked by the bulge on the bottom, thus avoiding the occurrence of suspension of the machine.

Preferably, in the above swimming pool sewage suction machine, the bottom of the base further defines a limit groove, the brush assembly is positioned on a middle part of the limit groove, and a maximum rotating angle $\alpha$ of the brush assembly is 90°.

A too large rotating angel of the brush assembly will make the brush assembly unable to clean the bottom surface of the swimming pool. The maximum rotating angle of the brush assembly limited to 90° can effectively prevent the problem of a too large angle, so that the swimming pool sewage suction machine will not have the cleaning efficiency impacted due to a too large angle of the brush assembly when cleaning the swimming pool.

Preferably, in the above swimming pool sewage suction machine, the brush assembly is positioned on a middle part of the bottom of the base.

The arrangement of the above structure can further enhance the balance of the swimming pool sewage suction machine.

Preferably, in the above swimming pool sewage suction machine, the bottom of the base is further provided with a magnet, and the magnets are positioned on two sides of the brush assembly respectively.

The magnet can attract some small metal articles, such as keys, on the bottom of the swimming pool, further enhancing the cleaning efficiency.

Preferably, in the above swimming pool sewage suction machine, the collision plate assembly includes a bumper and a driving bracket, the collision return assembly includes a guide shaft and a guide shaft return spring, the bumper is positioned on the edge of the base and connected to the base in a sliding manner, one end of the driving bracket abuts against the bumper, the other end of the driving bracket abuts against the rotary rod assembly, one end of the guide shaft is connected to the bumper, the other end of the guide shaft is connected inside the base in a sliding manner, the guide shaft return spring is sleeved on the guide shaft and provides a restoring force for the bumper.

The separate arrangements of the bumper and the driving bracket better facilitate the separate repair and replacement of the bumper. The guide shaft cooperates with the guide shaft return spring to better provide a restoring force for the bumper.

Preferably, the above swimming pool sewage suction machine further includes a bracket pulley, a bracket press plate and a press plate fastener, a bracket slide rail is arranged inside the base, the driving bracket is connected to the bracket slide rail in a sliding manner through the bracket pulley, the bracket press plate is connected inside the base through the press plate fastener, the bracket press plate is positioned above the driving bracket and limits the driving bracket in the height direction.

The bracket pulley cooperates with the bracket slide rail so that the bumper can extend into the base more smoothly after collision. The bracket press plate and the press plate fastener can prevent the driving bracket being forced up after collision, making the driving bracket always keep a linear motion.

Preferably, the above swimming pool sewage suction machine further includes a roller and a roller shaft, wherein a roller slideway is arranged inside the base, the bumper is provided with a shaft connection seat and the shaft connection seat extends into the base, the roller is sleeved on a middle part of the roller shaft and is positioned on the roller slideway inside the base, and an end part of the roller shaft is connected to the shaft connection seat on the bumper.

The roller, the roller shaft and the shaft connection seat cooperate with each other so that the bumper can extend into the base more smoothly after collision and can pop out more smoothly after the end of collision.

Preferably, in the above swimming pool sewage suction machine, the rotary rod assembly includes a rotary connection seat, a rotary rod and a rotary shaft, the rotary connection seat is arranged inside the base, the rotary rod defines thereon a rotating shaft hole, the rotary shaft passes through the rotating shaft hole on the rotary rod to connect to the rotary connection seat, one end of the rotary rod is connected to the collision plate assembly, the magnetic induction piece is arranged on the other end of the rotary rod, and a ratio of a distance between the rotating shaft hole and one end of the rotary rod to a distance between the rotating shaft hole and the other end of the rotary rod is 1:2~1:3.

Through the cooperation between the rotary connection seat, the rotary rod and the rotary shaft, the rotary rod assembly is more convenient to disassemble. The setting of distance ratio better improves the correctness of judgement; such a lever principle further reduces the disturbance of non-obstacles and non-boundaries on the machine during the course of walking underwater.

Preferably, in the above swimming pool sewage suction machine, the collision return assembly further includes a rotary rod return spring, one end of the rotary rod return spring is connected to the other end of the rotary rod, and the other end of the rotary rod return spring is connected to the base.

The rotary rod return spring is positioned between the rotary rod and the base, which is capable of providing an elastic restoring force for the rotary rod, and which after the end of collision can better return the rotary rod to the original position and hereby return the collision plate assembly to the original position.

Preferably, the above swimming pool sewage suction machine further includes a floating piece and a draw cord, one end of the draw cord is connected to the base, and the other end of the draw cord is connected to the floating piece.

The floating piece is capable of floating onto the water surface while the swimming pool sewage suction machine is working, so that a user can pull up the swimming pool sewage suction machine at any time through the floating piece and the draw cord.

A control method for the swimming pool sewage suction machine, wherein the control system further includes a current sampling module and a gyroscope, the driving wheel assembly includes a left drive motor, a left wheel, a right drive motor and a right wheel, and the method includes the following steps:

S1: the swimming pool sewage suction machine being turned on, the control system controlling the water pump assembly to start working, the current sampling module acquiring a working current of the water pump assembly and transmitting to the control system;

S2: the control system continuing monitoring the working current of the water pump assembly, and when the change of the working current of the water pump assembly exceeds 5 A, determining that the swimming pool sewage suction machine has entered water; then going to S3;

S3: the gyroscope acquiring spatial data of the current swimming pool sewage suction machine and transmitting to the control system, the control system continuing monitoring the spatial data of the swimming pool sewage suction machine, and when the spatial data of the swimming pool sewage suction machine does not change, determining that the swimming pool sewage suction machine has reached the bottom of the swimming pool and is in a stable posture, then saving the current spatial data as stable posture data and transmitting to the control system; then going to S4;

S4: the control system setting a basic rotating speed V, and setting a basic direction F through the gyroscope, then the control system controlling the left drive motor and the right drive motor to start;

S5: the left drive motor and the right drive motor driving respectively the left wheel and the right wheel to rotate synchronously, until the rotating speed of the left wheel and the right wheel reaches the basic rotating speed V and remains constant;

S6: the control system acquiring in real time the current spatial data through the gyroscope and comparing it with the stored stable posture data to determine whether the swimming pool sewage suction machine deviates from the basic direction F; if the swimming pool sewage suction machine deviates from the basic direction F, the control system speeding up the wheel with a relatively slow rotating speed and slowing down the wheel with a relatively fast rotating speed, so that the swimming pool sewage suction machine returns to the basic direction F;

S7: by the time, if the rotating speed of the left wheel and the right wheel does not reach the basic rotating speed V, the control system adjusting the left wheel and the right wheel synchronously to reach the basic rotating speed V;

S8: in the event of collision, the control system selecting randomly a left turn or right turn of 15~60° and controlling the swimming pool sewage suction machine to steer, then the control system resetting the reverse direction of the current direction as the basic direction F, and resaving the current spatial data as the stable posture data;

S9: the control system controlling the left drive motor and the right drive motor to rotate reversely, so that the swimming pool sewage suction machine advances in the basic direction F reset in S8 and the rotating speed of the left wheel and the right wheel reaches the basic rotating speed V;

S10: the control system acquiring the charge of the battery assembly; and when the charge of the battery assembly is 15-30% of the total charge, going to S12;

S11: repeating S6-S10; and

S12: the control system shutting down the water pump assembly, and when the swimming pool sewage suction machine collides with the boundary, the control system shutting down the left drive motor and the right drive motor and controlling the swimming pool sewage suction machine to power off.

Through the above control method, the stability of posture of the swimming pool sewage suction machine in entering water and walking underwater is guaranteed, further, a linear walk can be guaranteed during the course of walking underwater. When the swimming pool sewage suction machine hits on an obstacle or a boundary, the swimming pool sewage suction machine can automatically steer and walk in a reverse direction. Thus, through the continuous back and forth walk of the swimming pool sewage suction machine, the whole range of the swimming pool is covered.

DETAILED DESCRIPTION

The present disclosure is described below in further detail in conjunction with accompanying drawings and specific embodiments, which, however, do not form limitation on the present disclosure.

Embodiment 1

Figure 1:
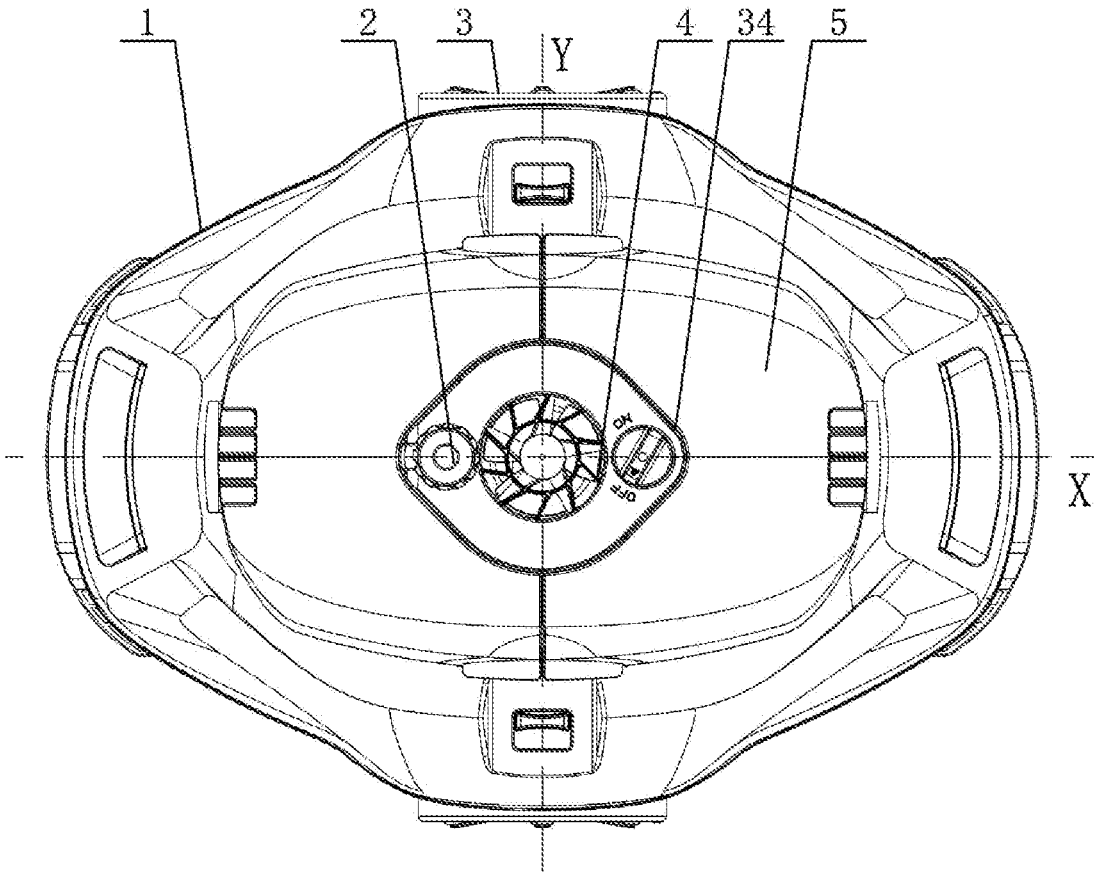
FIG. 1 is a top view of the present disclosure.
Figure 2:
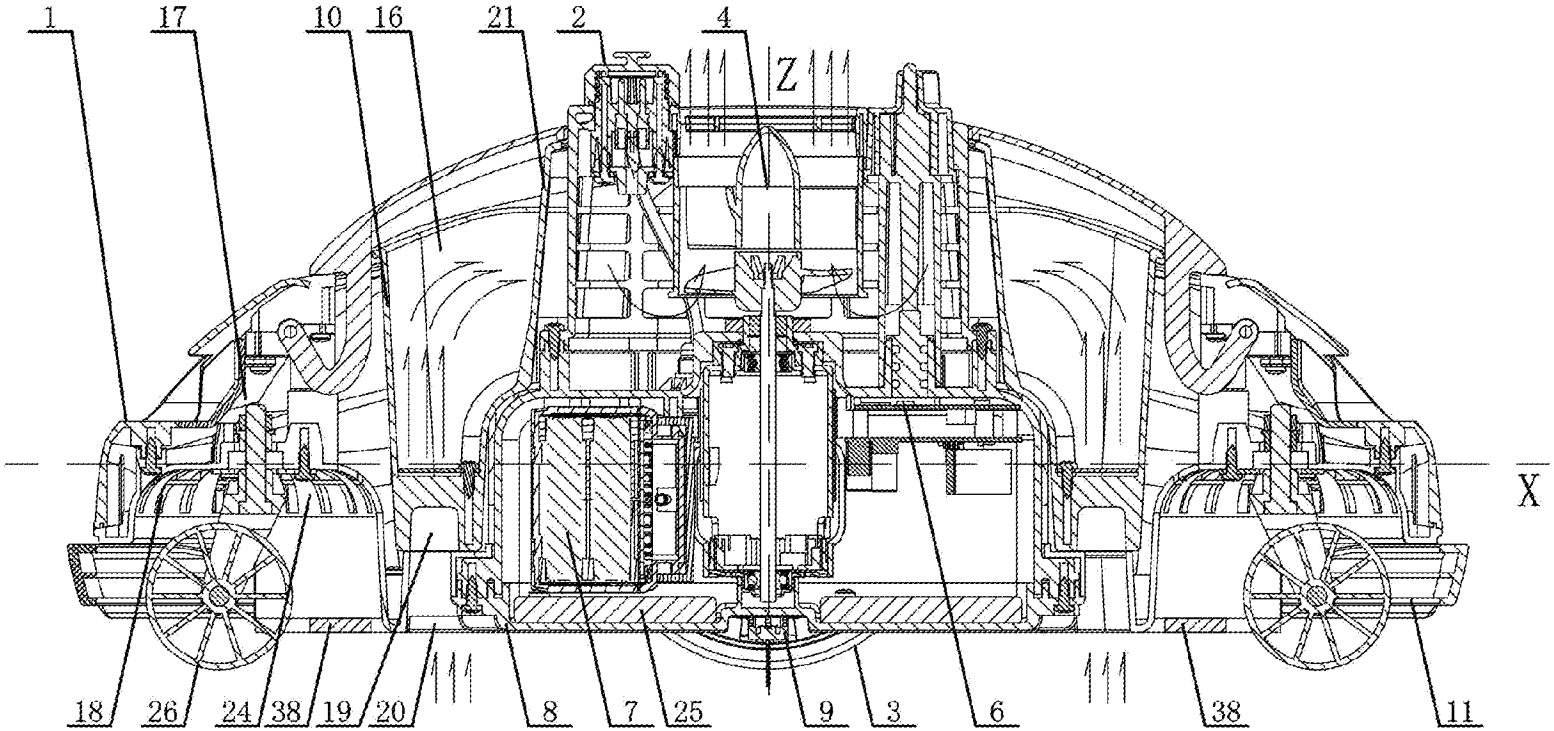
FIG. 2 is a sectional view of the present disclosure.
Figure 3:
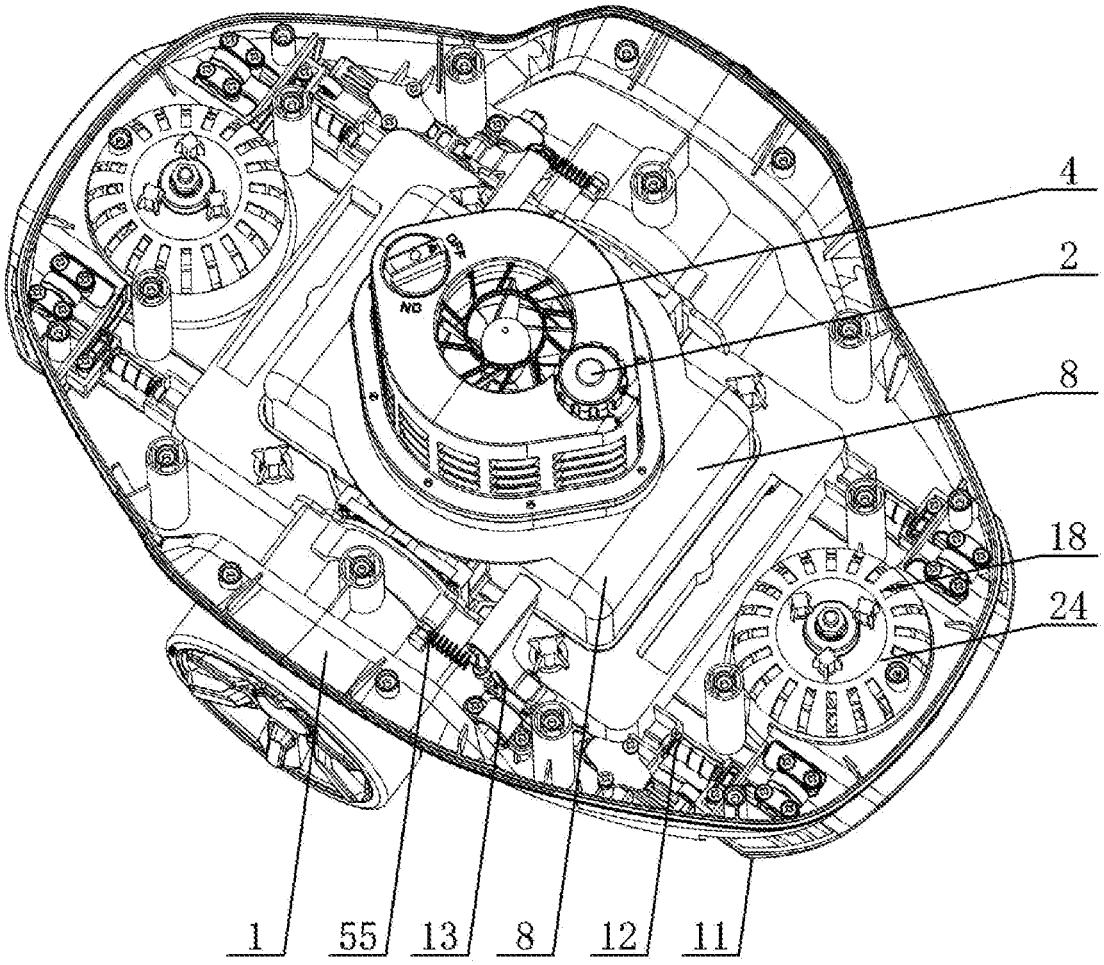
FIG. 3 is an internal structure diagram of the present disclosure.
Figure 4:
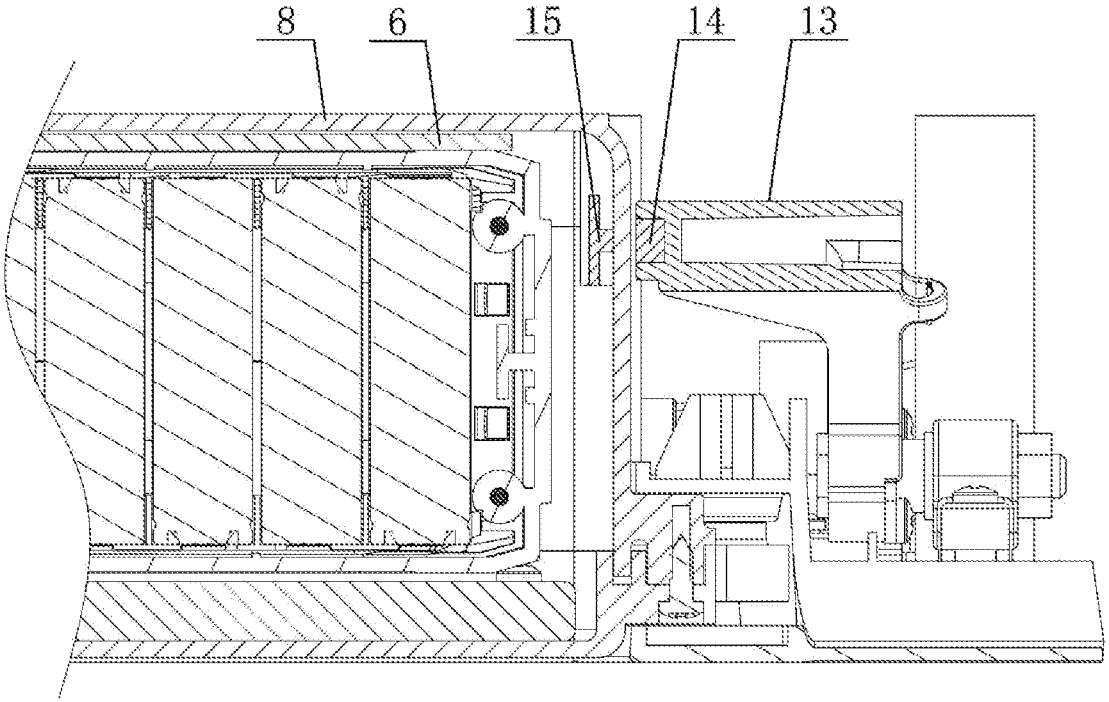
FIG. 4 is a sectional view of a rotary rod assembly in the present disclosure.
Figure 5:
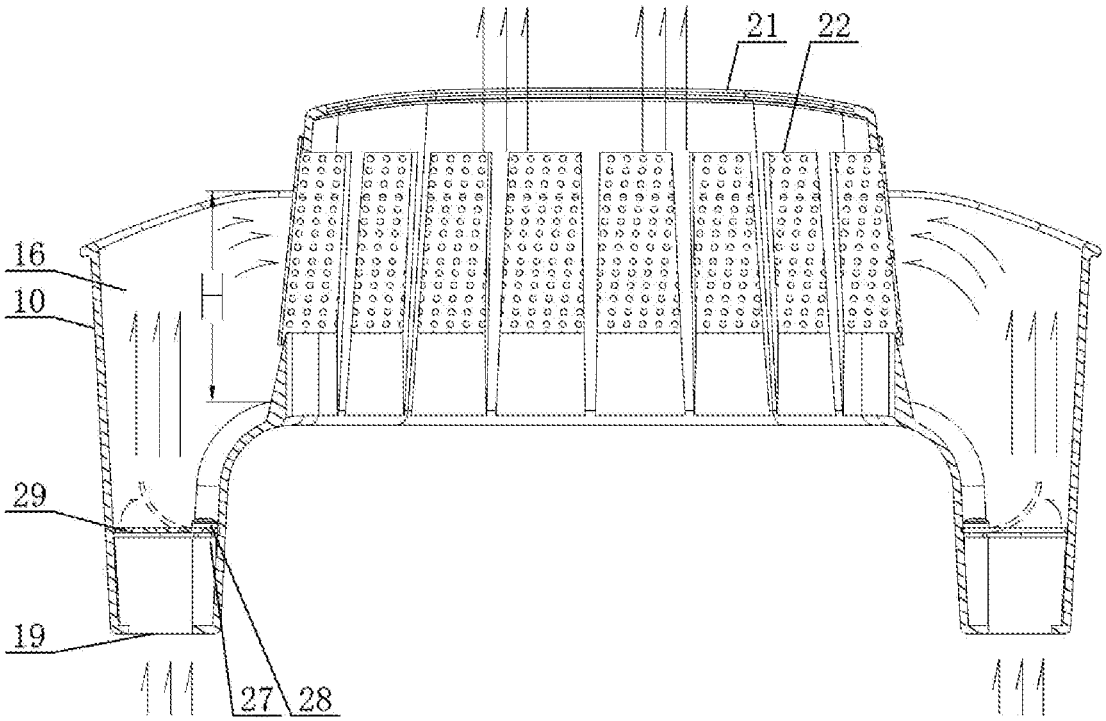
FIG. 5 is a sectional view of a collecting box in the present disclosure.
Figure 6:
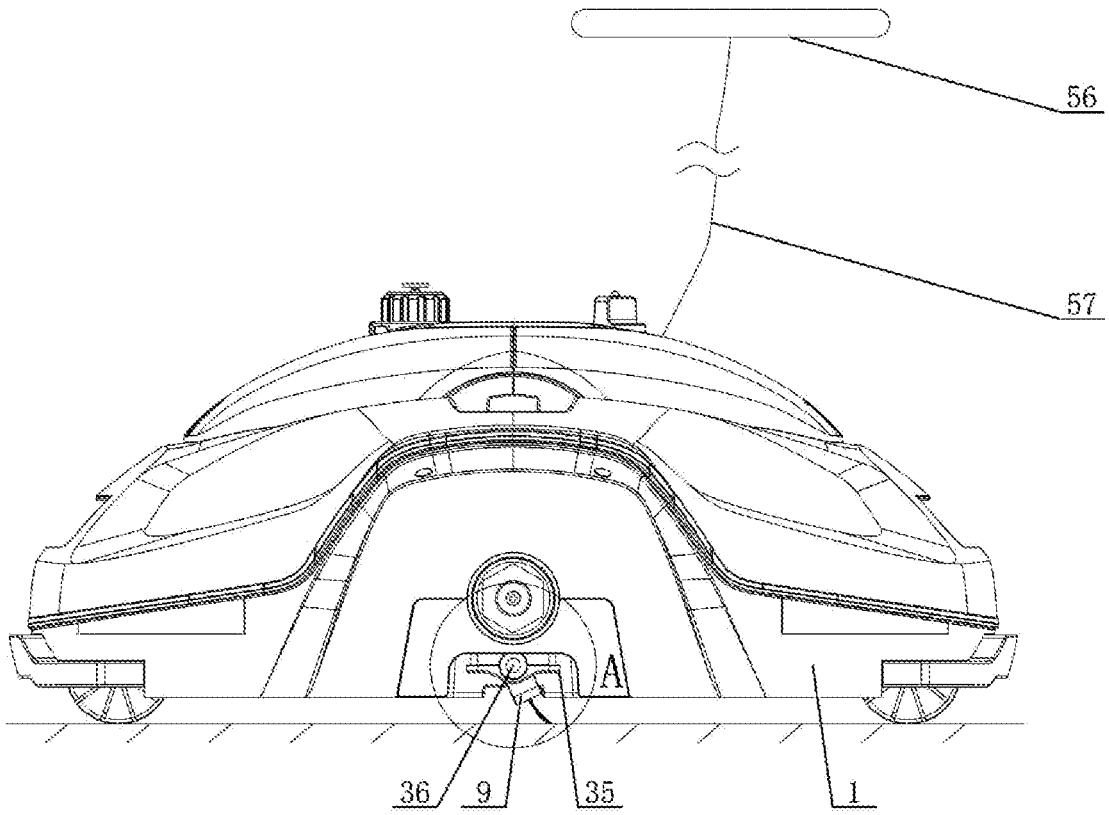
FIG. 6 is a structure diagram of the present disclosure.
Figure 7:
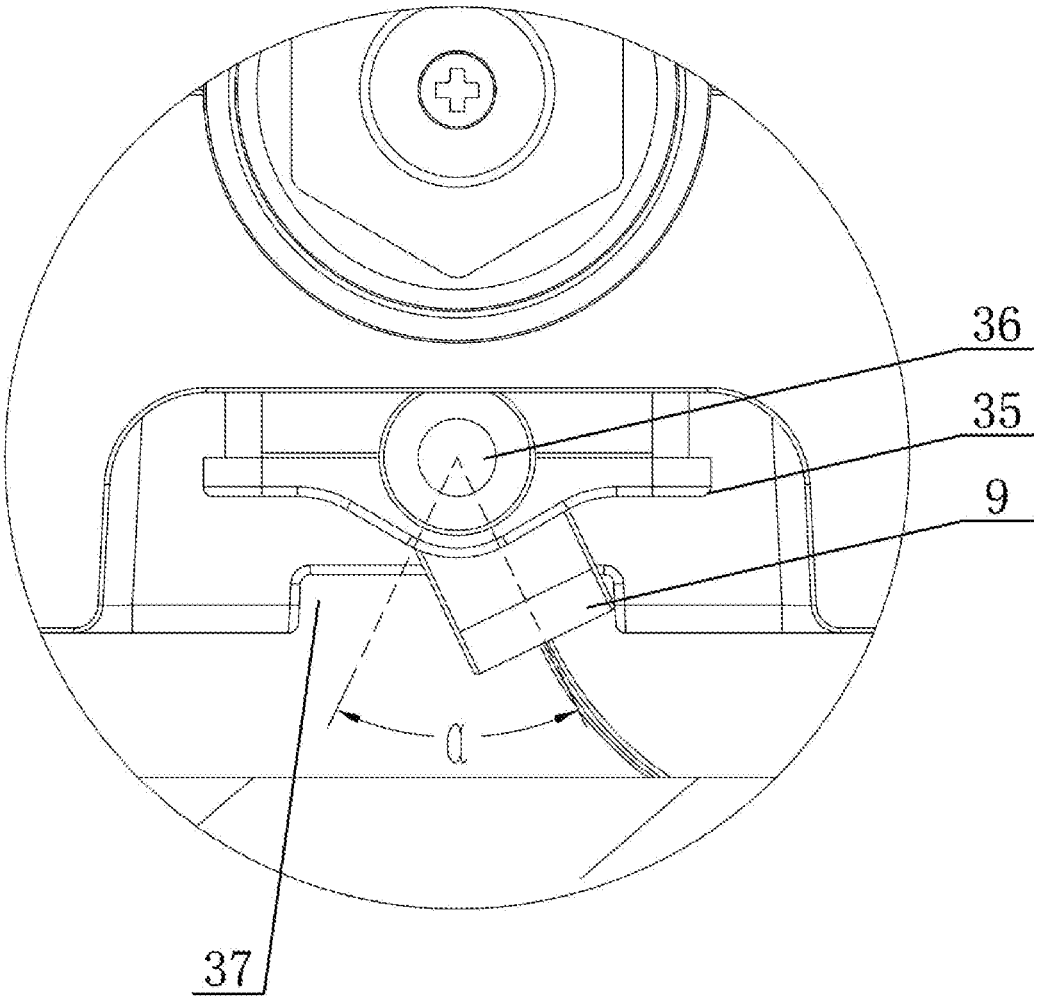
FIG. 7 is an enlarged view of Part A in FIG. 6.
Figure 8:
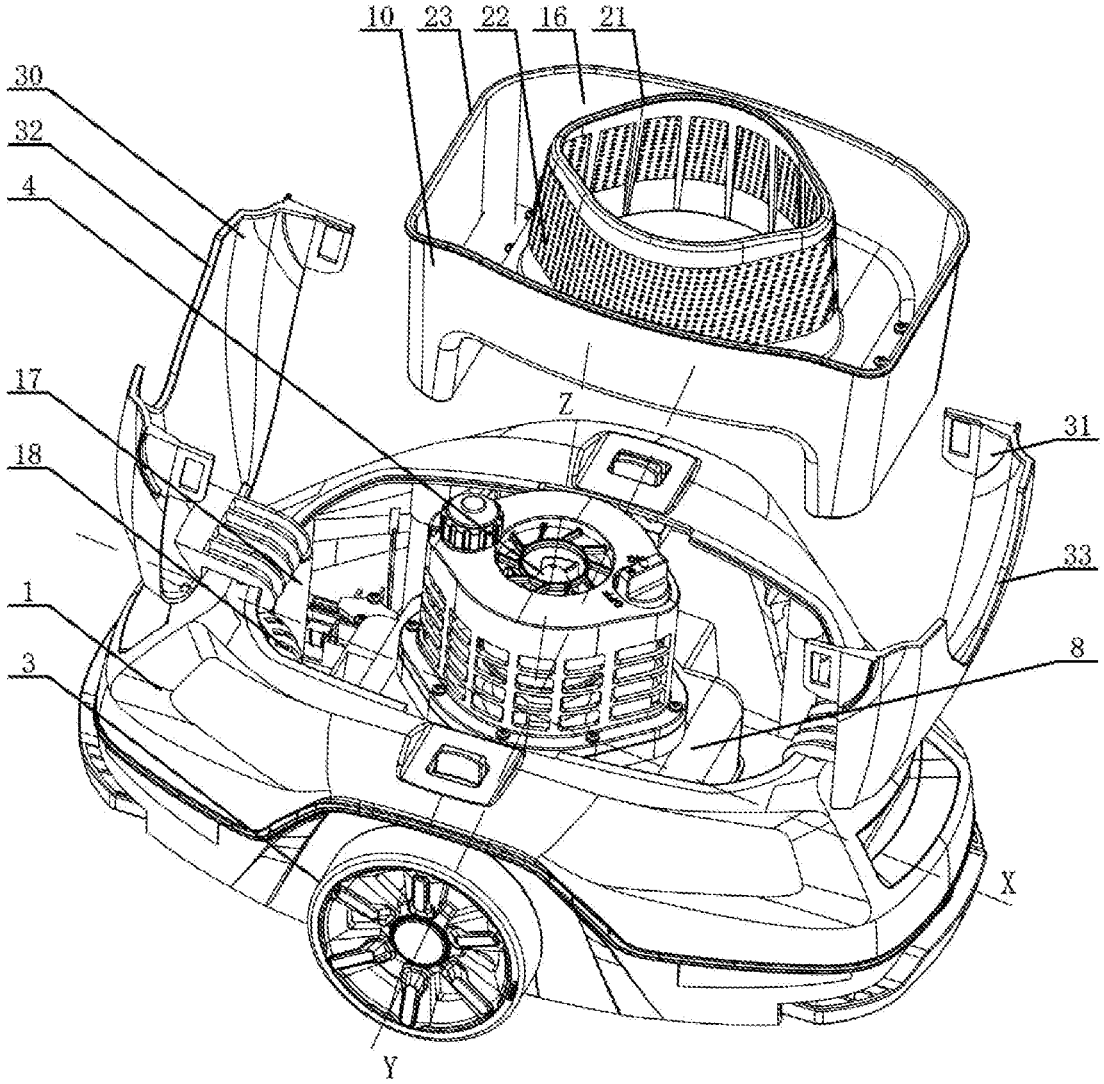
FIG. 8 is an exploded view of the present disclosure.
Figure 9:
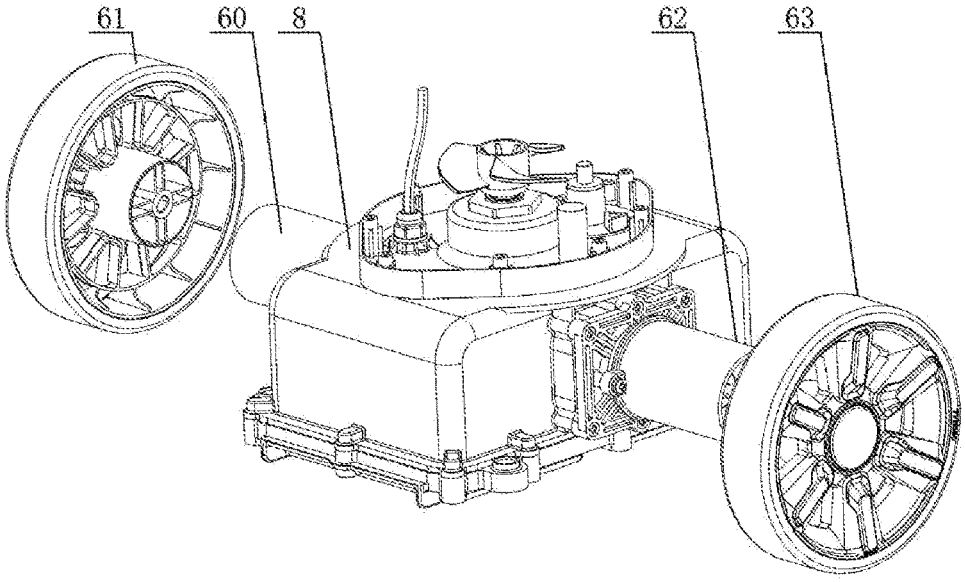
FIG. 9 is an exploded view of a driving wheel assembly in the present disclosure.
Figure 10:
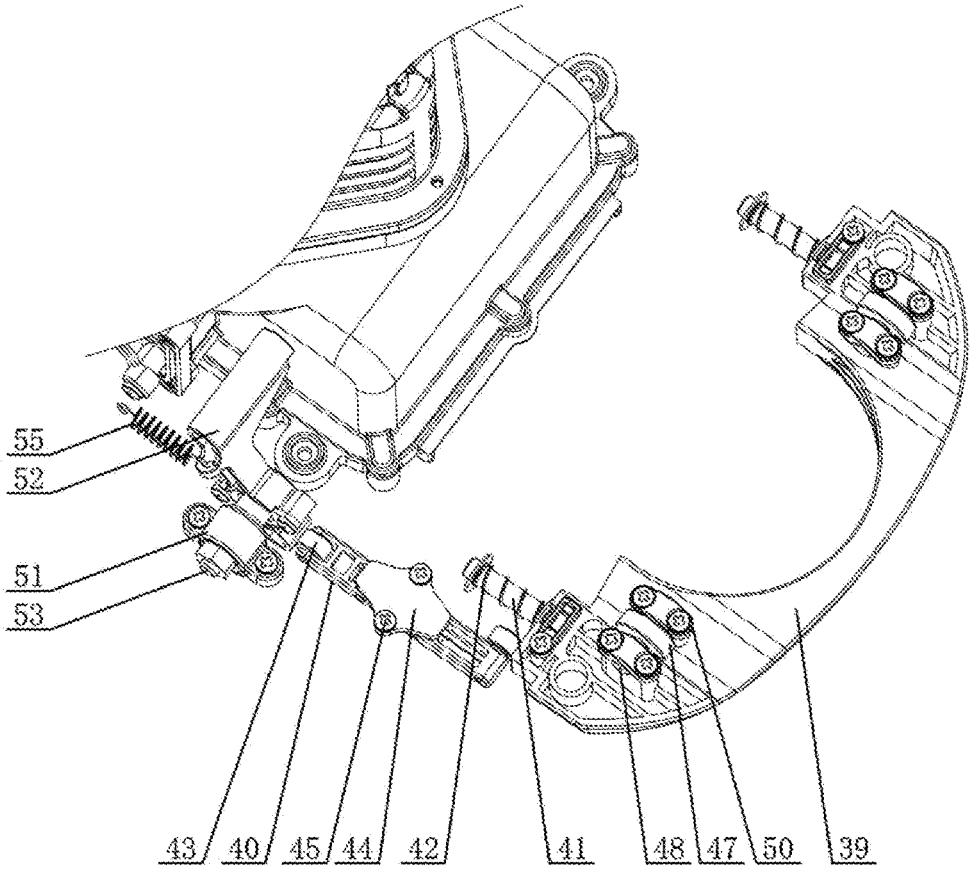
FIG. 10 is an exploded view of a collision plate assembly, a collision return assembly and a rotary rod assembly in the present disclosure.
Figure 11:
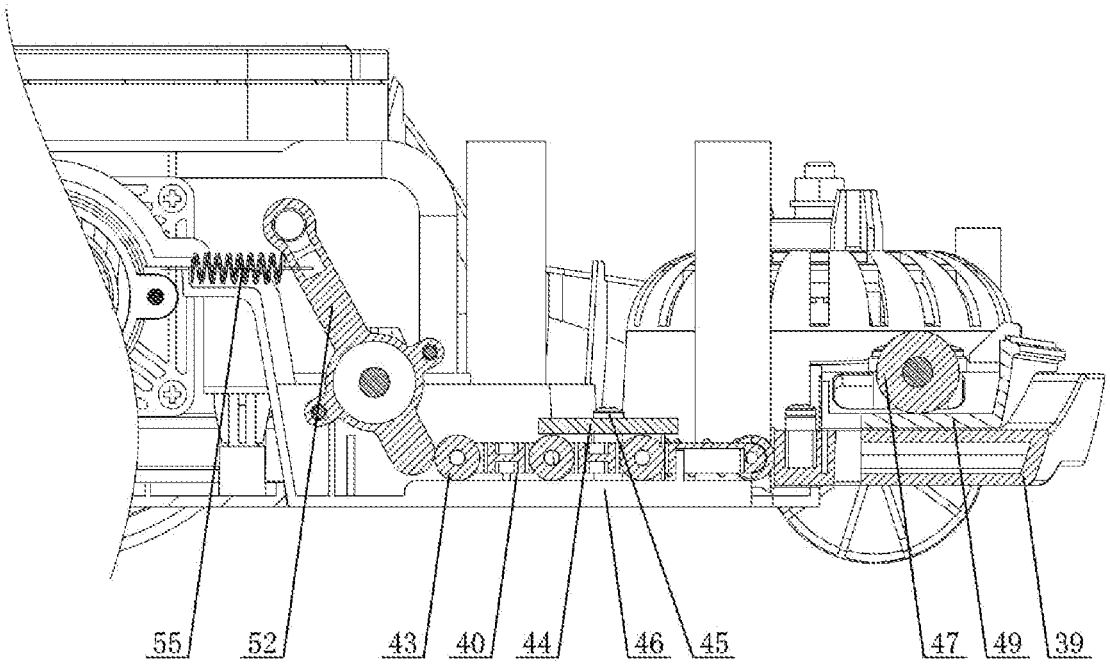
FIG. 11 is a sectional view of a collision plate assembly, a collision return assembly and a rotary rod assembly in the present disclosure.
Figure 12:
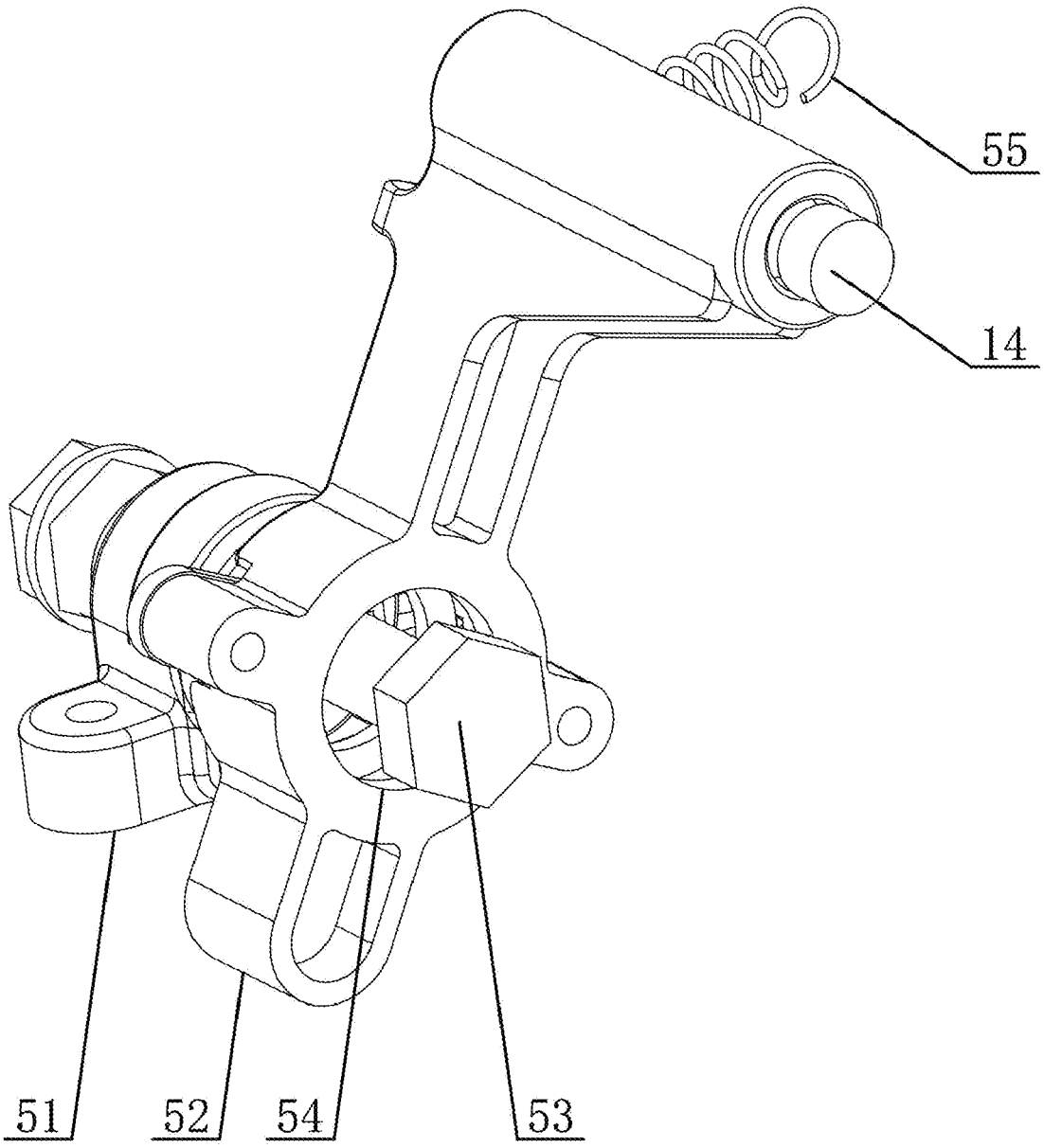
FIG. 12 is a structure diagram of a rotary rod assembly in the present disclosure.
Figure 13:
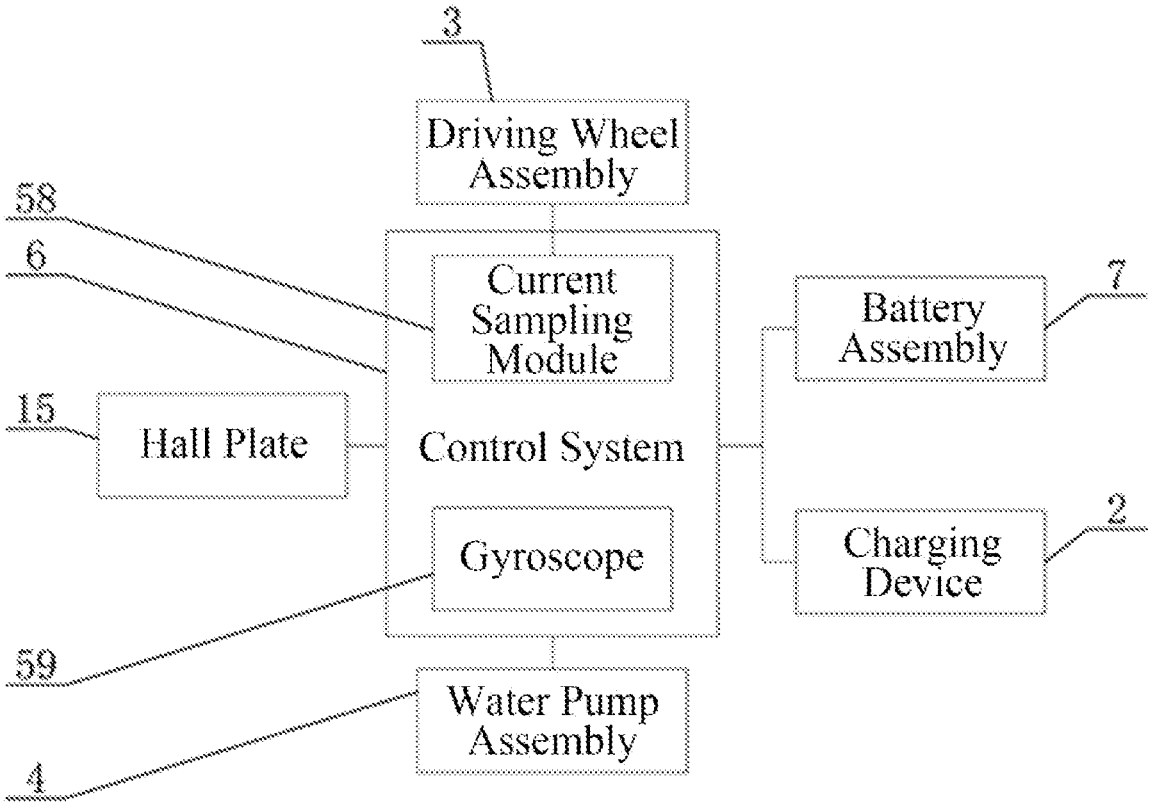
FIG. 13 is diagram of module connection of the present disclosure.

Referring to FIG. 1 to FIG. 13, a swimming pool sewage suction machine includes a base 1, a control system 6, a battery assembly 7, a driving wheel assembly 3, a sealing box 8, a water pump assembly 4, a collecting box 10, a top cover assembly 5, a brush assembly 9 and a charging device 2, wherein the control system 6 is positioned inside the sealing box 8, the charging device 2 is arranged on the base 1 and is electrically connected to the control system 6 inside the sealing box 8, the battery assembly 7 is arranged inside the sealing box 8 and is electrically connected to the control system 6, the brush assembly 9 is arranged on a bottom of the base 1, the swimming pool sewage suction machine has an X axis, a Y axis and a Z axis at a center along the length direction, width direction and height direction respectively, wherein the swimming pool sewage suction machine further includes a collision plate assembly 11, a collision return assembly 12, a rotary rod assembly 13, a magnetic induction piece 14 and a Hall plate 15, wherein the sealing box 8 is arranged on a middle part of the bottom of the base 1, the driving wheel assembly 3 and the water pump assembly 4 are connected to the sealing box 8 respectively and are electrically connected to the control system 6, the interior of the base 1 is divided into an inner ring water distribution bin 16 and an outer ring water distribution bin 17 through the collecting box 10, a gas-liquid circulation hole 18 is further defined in both a front end and a rear end of the bottom of the base 1 and communicated with the outer ring water distribution bin 17, a sewage suction opening 19 communicated with the inner ring water distribution bin 16 is defined on a bottom of the collecting box 10, a sewage inlet 20 corresponding to the sewage suction opening 19 is further defined on the bottom of the base 1, the inner ring water distribution bin 16 is annular, a middle part of the collecting box 10 is provided with an up-down through annular docking base 21 and is sleeved on the water pump assembly 4, a filter screen 22 is arranged on a side wall of the annular docking base 21, an opening 23 is defined a top part of the collecting box 10, and the top cover assembly 5 is rotationally connected to the base 1 and covers the opening 23 on the top part of the collecting box 10, the collision plate assembly 11 is arranged on an edge of the base 1 and extends into the base 1, the collision return assembly 12 is arranged inside the base 1 and provides a restoring force for the collision plate assembly 11, the rotary rod assembly 13 is rotationally connected inside the base 1, one end of the rotary rod assembly 13 is connected to the collision plate assembly 11, the magnetic induction piece 14 is arranged on the other end of the rotary rod assembly 13, the Hall plate 15 is arranged inside the sealing box 8 and cooperates with the magnetic induction piece 14, and the Hall plate 15 is electrically connected to the control system 6.

When the swimming pool sewage suction machine is ready to enter water, a user places the machine into water horizontally. During such process, since the bottom of the base 1 is provided with the gas-liquid circulation hole 18 and the sewage inlet 20, the air and water squeezed by the bottom of the base 1 will automatically and continuously enter the inner ring water distribution bin 16 and the outer ring water distribution bin 17 along the gas-liquid circulation hole 18, the sewage inlet 20 and the sewage suction opening 19, thereby accelerating the speed of the swimming pool sewage suction machine to enter water, reducing the reacting force of the water against the bottom of the base 1, and improving the stability of posture of the swimming pool sewage suction machine during the water entry course; in addition, since the sealing box 8 is arranged on the middle part of the bottom of the base 1, inside which sealing box 8 various control parts are generally gathered to be sealed against water, the arrangement of the position of the sealing box 8 makes the gravity center of the whole swimming pool sewage suction machine tend to the center of the base 1, further enhancing the stability of the swimming pool sewage suction machine during the water entry course and meanwhile enhancing the stability of the swimming pool sewage suction machine during the underwater walking course.

During the course of the swimming pool sewage suction machine walking underwater, under the action of an elastic restoring force of the collision return assembly 12, an outward acting force can be given to the collision plate assembly 11 constantly, so that the swimming pool sewage suction machine will not make a misjudgment of an obstacle and a boundary when passing through a slope or concave-convex place at the bottom of the swimming pool or when the flow direction of water changes.

When the swimming pool sewage suction machine hits on an obstacle or a boundary, since the collision plate assembly 11 suffers a great impact force within a short time, it will quickly slide into the base 1 under the action of the impact force; during the sliding process of the collision plate assembly 1, the rotary rod assembly 13 will be pushed to rotate, thereby driving the magnetic induction piece 14 on the other end of the rotary rod assembly 13 to get away from the Hall plate 15; by the time, the swimming pool sewage suction machine can accurately determine that it currently hits on an obstacle or the pool boundary. When the swimming pool sewage suction machine leaves the obstacle or pool boundary, under the action of an elastic restoring force of the collision return assembly 12, the collision plate assembly 11 can automatically return to the original position, making a preparation for a next collision detection.

Preferably, a diversion bin 24 is further provided on the base 1 at the gas-liquid circulation hole 18, the diversion bin 24 is in the shape of a cover body with an opening downward and the projection of the diversion bin 24 in the height direction of the swimming pool sewage suction machine is on the X axis, and the gas-liquid circulation holes 18 are distributed on the diversion bin 24 in an annular array.

Preferably, a counterweight 25 is further arranged inside the sealing box 8 and the counterweight 25 is provided to be symmetrical in front and rear with the Y axis as a center line.

Preferably, the swimming pool sewage suction machine further includes a universal wheel 26, wherein the number of the universal wheel 26 is two and they are connected to the front end and the rear end of the bottom of the base 1 respectively, the projection of the universal wheel 26 in the height direction of the swimming pool sewage suction machine is on the X axis, there are two driving wheel assemblies 3 and they are connected to middle parts of left and right side surfaces of the sealing box 8 respectively, and the projection of the driving wheel assembly 3 in the height direction of the swimming pool sewage suction machine is on the Y axis.

Preferably, a distance between a center of the universal wheel 26 and a center plane of the sealing box 8 is 120 mm.

Preferably, the sealing box 8 is positioned at an intersection of the X axis, the Y axis and the Z axis, and the collecting box 10 is provided to be symmetrical with the X axis and Y axis as center lines.

Preferably, a ratio of a sectional area of the sewage suction opening 19 to a sectional area of the gas-liquid circulation hole 18 is 1.2:1.

Preferably, a blocking structure is further arranged inside the collecting box 10 close to the sewage suction opening 19, the blocking structure includes a blocking connection seat 27, a fastener 28 and a flexible baffle 29, the blocking connection seat 27 is arranged on an inner wall of the collecting box 10, one end of the flexible baffle 29 is connected onto the blocking connection seat 27 through the fastener 28, and the other end of the flexible baffle 29 covers the sewage suction opening 19.

Preferably, the top cover assembly 5 includes a left rotating cover 30 and a right rotating cover 31, the left rotating cover 30 and the right rotating cover 31 are rotatably connected onto the base 1 respectively, a left notch 32 is defined on the left rotating cover 30, a right notch 33 is defined on the right rotating cover 31, the left notch 32 and the right notch 33 enclose a sleeve-connection opening 34 which is positioned on the edge of the water pump assembly 4.

Preferably, the inner ring water distribution bin 16 has a depth H of 20 mm, the inner ring water distribution bin 16 has a sectional area of 20000 $mm^2$, and the sewage suction opening 19 has a sectional area of 2000 $mm^2$.

Preferably, two ends of the base 1 are provided with a rotating connection seat 35, two ends of the brush assembly 9 are provided with a rotating shaft 36, and the brush assembly 9 is rotatably connected to the base 1 through the rotating shaft 36 and the rotating connection seat 35.

Preferably, the bottom of the base 1 further defines a limit groove 37, the brush assembly 9 is positioned on a middle part of the limit groove 37, and a maximum rotating angle $\alpha$ of the brush assembly 9 is 90°.

Preferably, the brush assembly 9 is positioned on a middle part of the bottom of the base 1.

Preferably, the bottom of the base 1 is further provided with a magnet 38, and the magnets 38 are positioned on two sides of the brush assembly 9 respectively.

Preferably, the collision plate assembly 11 includes a bumper 39 and a driving bracket 40, the collision return assembly 12 includes a guide shaft 41 and a guide shaft return spring 42, the bumper 39 is positioned on the edge of the base 1 and connected to the base 1 in a sliding manner, one end of the driving bracket 40 abuts against the bumper 39, the other end of the driving bracket 40 abuts against the rotary rod assembly 13, one end of the guide shaft 41 is connected to the bumper 39, the other end of the guide shaft 41 is connected inside the base 1 in a sliding manner, the guide shaft return spring 42 is sleeved on the guide shaft 41 and provides a restoring force for the bumper 39.

Preferably, the swimming pool sewage suction machine further includes a bracket pulley 43, a bracket press plate 44 and a press plate fastener 45, a bracket slide rail 46 is arranged inside the base 1, the driving bracket 40 is connected to the bracket slide rail 46 in a sliding manner through the bracket pulley 43, the bracket press plate 44 is connected inside the base 1 through the press plate fastener 45, the bracket press plate 44 is positioned above the driving bracket 40 and limits the driving bracket 40 in the height direction.

Preferably, the swimming pool sewage suction machine further includes a roller 47 and a roller shaft 48, wherein a roller slideway 49 is arranged inside the base 1, the bumper 39 is provided with a shaft connection seat 50 and the shaft connection seat 50 extends into the base 1, the roller 47 is sleeved on a middle part of the roller shaft 48 and is positioned on the roller slideway 49 inside the base 1, and an end part of the roller shaft 48 is connected to the shaft connection seat 50 on the bumper 39.

Preferably, the rotary rod assembly 13 includes a rotary connection seat 51, a rotary rod 52 and a rotary shaft 53, the rotary connection seat 51 is arranged inside the base 1, the rotary rod 52 defines thereon a rotating shaft hole 54, the rotary shaft 53 passes through the rotating shaft hole 54 on the rotary rod 52 to connect to the rotary connection seat 51, one end of the rotary rod 52 is connected to the collision plate assembly 11, the magnetic induction piece 14 is arranged on the other end of the rotary rod 52, and a ratio of a distance between the rotating shaft hole 54 and one end of the rotary rod 52 to a distance between the rotating shaft hole 54 and the other end of the rotary rod 52 is 1:2.

Preferably, the collision return assembly 12 further includes a rotary rod return spring 55, one end of the rotary rod return spring 55 is connected to the other end of the rotary rod 52, and the other end of the rotary rod return spring 55 is connected to the base 1.

Preferably, the swimming pool sewage suction machine further includes a floating piece 56 and a draw cord 57, one end of the draw cord 57 is connected to the base 1, and the other end of the draw cord 57 is connected to the floating piece 56.

More specifically, during the water entry course, on one hand, air and water currents under the gathering function of the diversion bin 24 will automatically flow toward the gas-liquid circulation holes 18 and then flow into the outer ring water distribution bin 17; since the gas-liquid circulation holes 18 are distributed on the diversion bin 24 in an annular array, the water currents can enter the gas-liquid circulation holes 18 more smoothly; on the other hand, air and water currents will flow into the inner ring water distribution bin 16 along the sewage inlet 20 and the sewage suction opening 19, accelerating the speed of the swimming pool sewage suction machine to enter water.

During the water entry course, since the inner ring water distribution bin 16 is annular and the annular docking base 21 on the middle part of the collecting box 10 is sleeved on the water pump assembly 4 and the water pump assembly 4 is further connected to the sealing box 8, the water entering the inner ring water distribution bin 16 will always rise around the water pump assembly 4 at the center of the base 1, moreover, since the sectional area of the sewage suction opening 19 is greater than the sectional area of the gas-liquid circulation hole 18, the volume entering the inner ring water distribution bin 16 is greater than that entering the outer ring water distribution bin 17; therefore, the center of gravity of the whole swimming pool sewage suction machine can be kept stable during the course of the machine entering water. In addition, the sealing box 8 is arranged on the middle part of the bottom of the base 1, the water pump assembly 4 is connected to the sealing box 8, the counterweight 25 is further arranged inside the sealing box 8 and the counterweight 25 is provided to be symmetrical in front and rear with the Y axis as a center line, and the driving wheel assemblies 3 are connected to middle parts of left and right side surfaces of the sealing box 8, all of which together enhance greatly the gravity center anchoring function of the sealing box 8, so that the gravity center of the whole machine tends to the center of the machine, further improving the stability of posture of the swimming pool sewage suction machine during the water entry course, and enhancing the stability of posture of the swimming pool sewage suction machine during the underwater walking course.

During the course of the swimming pool sewage suction machine walking underwater, when the machine moves forward, the magnet 38 will attract in advance some small metal articles, such as keys, on the bottom of the swimming pool, then the brush assembly 9 will clean the dirt on the surface of the swimming pool, meanwhile, since the rotating shaft 36 and the rotating connection seat 35 are rotatably connected, during the course of contacting the surface of the swimming pool, the brush assembly 9 will be driven by the friction force on the surface of the swimming pool to automatically rotate in a reverse direction of the walking direction of the machine, such that the machine cannot be jacked through the brush assembly 9 when passing through the bulged parts on the surface of the swimming pool. Manual corrective measures are saved, and the cleaning efficiency of the machine is improved.

During the course of the swimming pool sewage suction machine walking underwater, under the action of elastic restoring forces of the rotary rod return spring 55 and the guide shaft return spring 42, an outward acting force can be given to the bumper 39 constantly, so that the swimming pool sewage suction machine will not make a misjudgment of an obstacle and a boundary when passing through a slope or concave-convex place at the bottom of the swimming pool or when the flow direction of water changes. The setting of the ratio of the distance between the rotating shaft hole 54 and one end of the rotary rod 52 to the distance between the rotating shaft hole 54 and the other end of the rotary rod 52 further increases the difficulty of rotation of the rotary rod 52, further reducing the impact of various underwater negative factors on the machine and improving the correctness of judgment of an obstacle and a boundary.

When the swimming pool sewage suction machine hits on an obstacle or a boundary, since the bumper 39 suffers a great impact force within a short time, it will quickly slide into the base 1 through the roller 47 under the action of the impact force; during the sliding process of the bumper 39, the driving bracket 40 will be pushed to slide inwards, and during the sliding process of the driving bracket 40, the rotary rod 52 will be pushed to rotate, thereby driving the magnetic induction piece 14 on the other end of the rotary rod 52 to get away from the Hall plate 15; by the time, the swimming pool sewage suction machine can accurately determine that it currently hits on an obstacle or the pool boundary.

When the swimming pool sewage suction machine leaves the obstacle or pool boundary, under the action of elastic restoring forces of the rotary rod return spring 55 and the guide shaft return spring 42, the bumper 39 can automatically return to the original position, making a preparation for a next collision detection.

A control method for the swimming pool sewage suction machine, wherein the control system 6 further includes a current sampling module 58 and a gyroscope 59, the driving wheel assembly 3 includes a left drive motor 60, a left wheel 61, a right drive motor 62 and a right wheel 63, and the method includes the following steps:

S1: the swimming pool sewage suction machine is turned on, the control system 6 controls the water pump assembly 4 to start working, the current sampling module 58 acquires a working current of the water pump assembly 4 and transmits to the control system 6;

S2: the control system 6 continues monitoring the working current of the water pump assembly 4, and when the change of the working current of the water pump assembly 4 exceeds 5 A, the control system 6 determines that the swimming pool sewage suction machine has entered water; then go to S3;

S3: the gyroscope 59 acquires spatial data of the current swimming pool sewage suction machine and transmits to the control system 6, the control system 6 continues monitoring the spatial data of the swimming pool sewage suction machine, and when the spatial data of the swimming pool sewage suction machine does not change, the gyroscope 59 determines that the swimming pool sewage suction machine has reached the bottom of the swimming pool and is in a stable posture, then saves the current spatial data as stable posture data and transmits to the control system 6; then go to S4;

S4: the control system 6 sets a basic rotating speed V, and sets a basic direction F through the gyroscope 59, then the control system 6 controls the left drive motor 60 and the right drive motor 62 to start;

S5: the left drive motor 60 and the right drive motor 62 drives respectively the left wheel 61 and the right wheel 63 to rotate synchronously, until the rotating speed of the left wheel 61 and the right wheel 63 reaches the basic rotating speed V and remains constant;

S6: the control system 6 acquires in real time the current spatial data through the gyroscope 59 and compares it with the stored stable posture data to determine whether the swimming pool sewage suction machine deviates from the basic direction F; if the swimming pool sewage suction machine deviates from the basic direction F, the control system 6 speeds up the wheel with a relatively slow rotating speed and slows down the wheel with a relatively fast rotating speed, so that the swimming pool sewage suction machine returns to the basic direction F;

S7: by the time, if the rotating speed of the left wheel 61 and the right wheel 63 does not reach the basic rotating speed V, the control system 6 adjusts the left wheel 61 and the right wheel 63 synchronously to reach the basic rotating speed V;

S8: in the event of collision, the control system 6 selects randomly a left turn or right turn of 15~60° and controls the swimming pool sewage suction machine to steer, then the control system 6 resets the reverse direction of the current direction as the basic direction F, and resaves the current spatial data as the stable posture data;

S9: the control system 6 controls the left drive motor 60 and the right drive motor 62 to rotate reversely, so that the swimming pool sewage suction machine advances in the basic direction F reset in S8 and the rotating speed of the left wheel 61 and the right wheel 63 reaches the basic rotating speed V;

S10: the control system 6 acquires the charge of the battery assembly 7; and when the charge of the battery assembly 7 is 15-30% of the total charge, go to S12;

S11: repeat S6-S10; and

S12: the control system 6 shuts down the water pump assembly 4, and when the swimming pool sewage suction machine collides with the boundary, the control system 6 shuts down the left drive motor 60 and the right drive motor 62 and controls the swimming pool sewage suction machine to power off.

By the time, the user can pull up the swimming pool sewage suction machine through the floating piece 56 and the draw cord 57, and charge the swimming pool sewage suction machine through the charging device 2.

Embodiment 2

A distance between a center of the universal wheel 26 and a center plane of the sealing box 8 is 200 mm.

A ratio of a sectional area of the sewage suction opening 19 to a sectional area of the gas-liquid circulation hole 18 is 1.8:1.

The inner ring water distribution bin 16 has a depth H of 120 mm, the inner ring water distribution bin 16 has a sectional area of 60000 $mm^2$, and the sewage suction opening 19 has a sectional area of 6000 $mm^2$.

A ratio of a distance between the rotating shaft hole 54 and one end of the rotary rod 52 to a distance between the rotating shaft hole 54 and the other end of the rotary rod 52 is 1:3.

In S10, when the charge of the battery assembly 7 is 30% of the total charge, go to S12; other implementations are the same as Embodiment 1.

Embodiment 3

A distance between a center of the universal wheel 26 and a center plane of the sealing box 8 is 160 mm.

A ratio of a sectional area of the sewage suction opening 19 to a sectional area of the gas-liquid circulation hole 18 is 1.5:1.

The inner ring water distribution bin 16 has a depth H of 70 mm, the inner ring water distribution bin 16 has a sectional area of 40000 $mm^2$, and the sewage suction opening 19 has a sectional area of 4000 $mm^2$.

A ratio of a distance between the rotating shaft hole 54 and one end of the rotary rod 52 to a distance between the rotating shaft hole 54 and the other end of the rotary rod 52 is 1:2.5.

In S10, when the charge of the battery assembly 7 is 22% of the total charge, go to S12.

Other implementations are the same as Embodiment 1.

To sum up, the above are preferred embodiments of the present disclosure. Any equivalent changes and modifications made according to the scope of patent of this application are intended to be covered in the scope of the present disclosure.

What is claimed is:

1. A swimming pool sewage suction machine, comprising a base, a control system, a battery assembly, a driving wheel assembly, a sealing box, a water pump assembly, a collecting box, a top cover assembly, a brush assembly and a charging device, wherein the control system is positioned inside the sealing box, the charging device is arranged on the base and is electrically connected to the control system inside the sealing box, the battery assembly is arranged inside the sealing box and is electrically connected to the control system, the brush assembly is arranged on a bottom of the base, the swimming pool sewage suction machine has an X axis, a Y axis and a Z axis at a center along the length direction, width direction and height direction respectively, wherein the swimming pool sewage suction machine further comprises a collision plate assembly, a collision return assembly, a rotary rod assembly, a magnetic induction piece and a Hall plate, wherein the sealing box is arranged on a middle part of the bottom of the base, the driving wheel assembly and the water pump assembly are connected to the sealing box respectively and are electrically connected to the control system, the interior of the base is divided into an inner ring water distribution bin and an outer ring water distribution bin through the collecting box, a gas-liquid circulation hole is further defined in both a front end and a rear end of the bottom of the base and communicated with the outer ring water distribution bin, a sewage suction opening communicated with the inner ring water distribution bin is defined on a bottom of the collecting box, a sewage inlet corresponding to the sewage suction opening is further defined on the bottom of the base, the inner ring water distribution bin is annular, a middle part of the collecting box is provided with an up-down through annular docking base and is sleeved on the water pump assembly, a filter screen is arranged on a side wall of the annular docking base, an opening is defined a top part of the collecting box, and the top cover assembly is rotationally connected to the base and covers the opening on the top part of the collecting box, the collision plate assembly is arranged on an edge of the base and extends into the base, the collision return assembly is arranged inside the base and provides a restoring force for the collision plate assembly, the rotary rod assembly is rotationally connected inside the base, one end of the rotary rod assembly is connected to the collision plate assembly, the magnetic induction piece is arranged on the other end of the rotary rod assembly, the Hall plate is arranged inside the sealing box and cooperates with the magnetic induction piece, and the Hall plate is electrically connected to the control system.

2. The swimming pool sewage suction machine according to claim 1, wherein a diversion bin is further provided on the base at the gas-liquid circulation hole, the diversion bin is in the shape of a cover body with an opening downward and the projection of the diversion bin in the height direction of the swimming pool sewage suction machine is on the X axis, and the gas-liquid circulation holes are distributed on the diversion bin in an annular array.

3. The swimming pool sewage suction machine according to claim 1, wherein a counterweight is further arranged inside the sealing box and the counterweight is provided to be symmetrical in front and rear with the Y axis as a center line.

4. The swimming pool sewage suction machine according to claim 1, further comprising a universal wheel, wherein the number of the universal wheel is two and they are connected to the front end and the rear end of the bottom of the base respectively, the projection of the universal wheel in the height direction of the swimming pool sewage suction machine is on the X axis, there are two driving wheel assemblies and they are connected to middle parts of left and right side surfaces of the sealing box respectively, and the projection of the driving wheel assembly in the height direction of the swimming pool sewage suction machine is on the Y axis.

5. The swimming pool sewage suction machine according to claim 4, wherein a distance between a center of the universal wheel and a center plane of the sealing box is 120 mm-200 mm.

6. The swimming pool sewage suction machine according to claim 1, wherein the sealing box is positioned at an intersection of the X axis, the Y axis and the Z axis, and the collecting box is provided to be symmetrical with the X axis and Y axis as center lines.

7. The swimming pool sewage suction machine according to claim 1, wherein a ratio of a sectional area of the sewage suction opening to a sectional area of the gas-liquid circulation hole Y is 1.2:1~1.8:1.

8. The swimming pool sewage suction machine according to claim 1, wherein a blocking structure is further arranged inside the collecting box close to the sewage suction opening, the blocking structure comprises a blocking connection seat, a fastener and a flexible baffle, the blocking connection seat is arranged on an inner wall of the collecting box, one end of the flexible baffle is connected onto the blocking connection seat through the fastener, and the other end of the flexible baffle covers the sewage suction opening.

9. The swimming pool sewage suction machine according to claim 1, wherein the top cover assembly comprises a left rotating cover and a right rotating cover, the left rotating cover and the right rotating cover are rotatably connected onto the base respectively, a left notch is defined on the left rotating cover, a right notch is defined on the right rotating cover, the left notch and the right notch enclose a sleeve-connection opening which is positioned on the edge of the water pump assembly.

10. The swimming pool sewage suction machine according to claim 1, wherein the inner ring water distribution bin has a depth H of 20 mm~120 mm, the inner ring water distribution bin has a sectional area of 20000 $mm^2$~60000 $mm^2$, and the sewage suction opening has a sectional area of 2000 $mm^2$~6000 $mm^2$.

11. The swimming pool sewage suction machine according to claim 1, wherein two ends of the base are provided with a rotating connection seat, two ends of the brush assembly are provided with a rotating shaft, and the brush assembly is rotatably connected to the base through the rotating shaft and the rotating connection seat.

12. The swimming pool sewage suction machine according to claim 11, wherein the bottom of the base further defines a limit groove, the brush assembly is positioned on a middle part of the limit groove, and a maximum rotating angle $\alpha$ of the brush assembly is 90°.

13. The swimming pool sewage suction machine according to claim 11, wherein the brush assembly is positioned on a middle part of the bottom of the base.

14. The swimming pool sewage suction machine according to claim 1, wherein the bottom of the base is further provided with magnets, and the magnets are positioned on two sides of the brush assembly respectively.

15. The swimming pool sewage suction machine according to claim 1, wherein the collision plate assembly comprises a bumper and a driving bracket, the collision return assembly comprises a guide shaft and a guide shaft return spring, the bumper is positioned on the edge of the base and connected to the base in a sliding manner, one end of the driving bracket abuts against the bumper, the other end of the driving bracket abuts against the rotary rod assembly, one end of the guide shaft is connected to the bumper, the other end of the guide shaft is connected inside the base in a sliding manner, the guide shaft return spring is sleeved on the guide shaft and provides a restoring force for the bumper.

16. The swimming pool sewage suction machine according to claim 15, further comprising a bracket pulley, a bracket press plate and a press plate fastener, a bracket slide rail is arranged inside the base, the driving bracket is connected to the bracket slide rail in a sliding manner through the bracket pulley, the bracket press plate is connected inside the base through the press plate fastener, the bracket press plate is positioned above the driving bracket and limits the driving bracket in the height direction.

17. The swimming pool sewage suction machine according to claim 15, further comprising a roller and a roller shaft, wherein a roller slideway is arranged inside the base, the bumper is provided with a shaft connection seat (50) and the shaft connection seat extends into the base, the roller is sleeved on a middle part of the roller shaft and is positioned on the roller slideway inside the base, and an end part of the roller shaft is connected to the shaft connection seat on the bumper.

18. The swimming pool sewage suction machine according to claim 1, wherein the rotary rod assembly comprises a rotary connection seat, a rotary rod and a rotary shaft, the rotary connection seat is arranged inside the base, the rotary rod defines thereon a rotating shaft hole, the rotary shaft passes through the rotating shaft hole on the rotary rod to connect to the rotary connection seat, one end of the rotary rod is connected to the collision plate assembly, the magnetic induction piece is arranged on the other end of the rotary rod, and a ratio of a distance between the rotating shaft hole and one end of the rotary rod to a distance between the rotating shaft hole and the other end of the rotary rod is 1:2~1:3.

19. The swimming pool sewage suction machine according to claim 18, wherein the collision return assembly further comprises a rotary rod return spring, one end of the rotary rod return spring is connected to the other end of the rotary rod, and the other end of the rotary rod return spring is connected to the base.

20. The swimming pool sewage suction machine according to claim 1, further comprising a floating piece and a draw cord, one end of the draw cord is connected to the base, and the other end of the draw cord connected to the floating piece.

* * * * *